US006100470A

United States Patent [19]

Gretz

[11] Patent Number: 6,100,470

[45] Date of Patent: Aug. 8, 2000

[54] SEPARATABLE SNAP IN CONNECTORS FOR PRE-CONNECTORIZED CABLE

[75] Inventor: Thomas J. Gretz, Clarks Summit, Pa.

[73] Assignee: Arlington Industries, Inc., Scranton, Pa.

[21] Appl. No.: 09/258,237

[22] Filed: Feb. 26, 1999

[51] Int. Cl.[7] ..... H01R 13/46

[52] U.S. Cl. ..... 174/59; 174/17.08; 174/44; 174/50.52; 174/64; 439/359

[58] Field of Search ..... 174/59, DIG. 9, 174/17.08, 35 C, 44, 50.52, 64; 439/359, 360, 361

[56] References Cited

U.S. PATENT DOCUMENTS 4,940,424 7/1990 Odbert .
5,072,072 12/1991 Bawa et al. .
5,098,310 3/1992 Avramovich et al. .
5,326,934 7/1994 Lemaster et al. .
5,344,333 9/1994 Haag .
5,721,396 2/1998 Daoud ..... 174/59

FOREIGN PATENT DOCUMENTS 3726543 2/1989 Germany ..... 174/59
409 051 9/1966 Switzerland ..... 174/59

*Primary Examiner*—Dean A. Reichard
*Assistant Examiner*—Dhiru R Patel

[57] ABSTRACT

A pre-connectorized connector assembly for cables having a separable two component cable connector. The two components have a female component and a male component that fit together with a screw lock that can be unscrewed for separation. The female component has a snap fit ring to attach to a metal wall and the male component has a snap fit for locking to a cable.

2 Claims, 4 Drawing Sheets

SEPARATABLE SNAP IN CONNECTORS FOR PRE-CONNECTORIZED CABLE

FIELD OF THE INVENTION

The present invention relates to cable terminations and more particularly cable terminations for pre-connectorized cable which snap into place.

BACKGROUND OF THE INVENTION

Pre-connectorized cable assembled offsite and shipped to a user ready for installation has substantial economic benefits as well as reduction of installation time. A plug at the end of the cable will snap into a complimentary plug in a cable box. Frequently, the cables themselves are metal-clad cables usually with a helcical winding. Such pre-connectorized cable may use a snap in cable connector of a type shown in application U.S. Pat. No. 5,373,106. Once the snap in connector has been placed through a hole in an electrical outlet box, it is difficult to remove the connector.

SUMMARY OF THE INVENTION

The present invention relates to a pre-connectorized cable which has a two part separable snap in connector. The nose of the connector may contain a first plug to act as a termination for the cable to mate with a corresponding plug in an electrical outlet box. The connector is attached to the armored cable by a male component and joins with a female component in a removable fashion. The female component is adapted for snap fitting attachment to a wall with a cavity for receiving a plug. The male component which recesses into the female fitting and is held in place on the cable by a snap ring attachment. Another attachment device such as a lock screw locks the two components of the connector together until it is desired to separate them. Upon separation by releasing the locking screw; the male fitting with its attached cable and the plug are extracted from the assembly leaving the female fitting in place.

DETAILED DESCRIPTION

Figure 2:
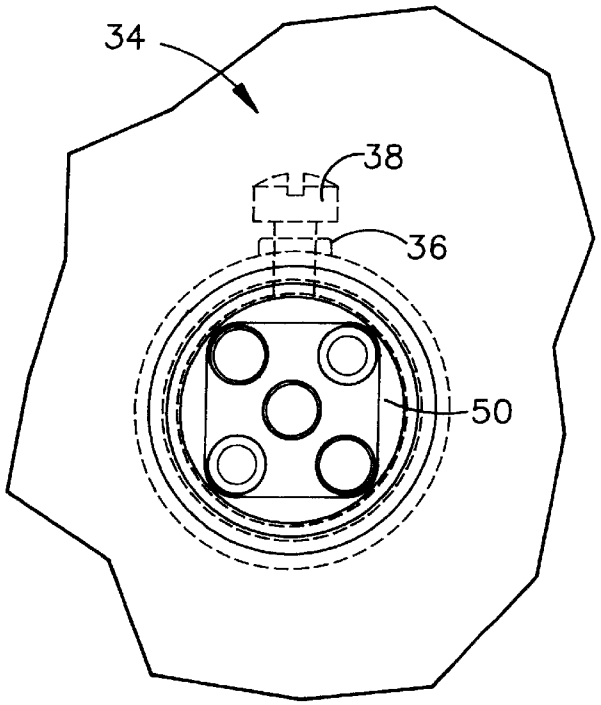
FIG. 2 is a view from the left end of FIG. 1.
Figure 1:
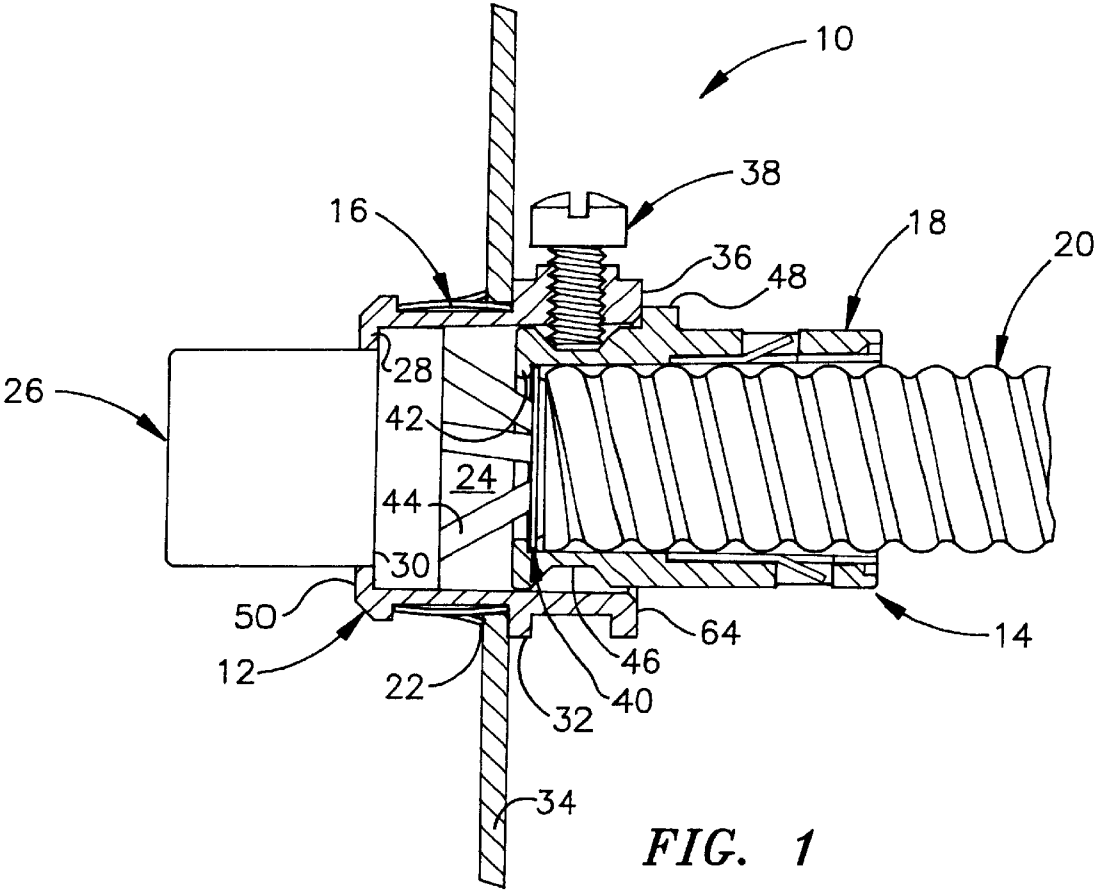
FIG. 1 is a sectional side view of the connector assembly including the cable female component, male component and plug as it would be found inserted in a wall.
Figure 5:
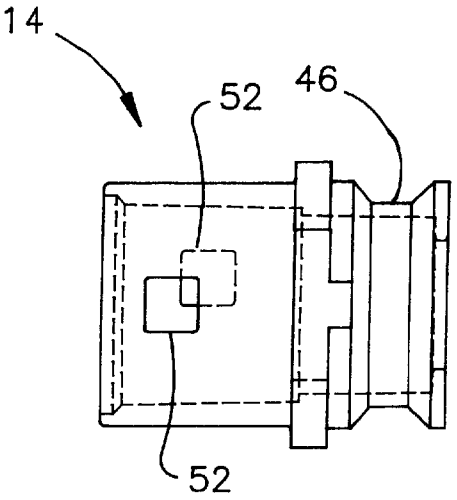
FIG. 5 is a side view of the male component.
Figure 4:
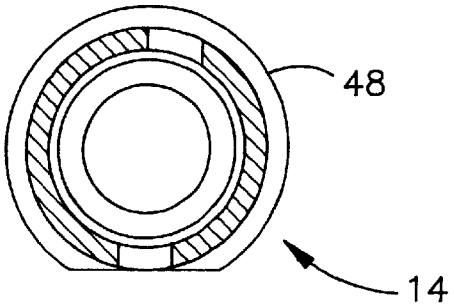
FIG. 4 is an end view of the left side of FIG. 3 taken on section 4—4.
Figure 3:
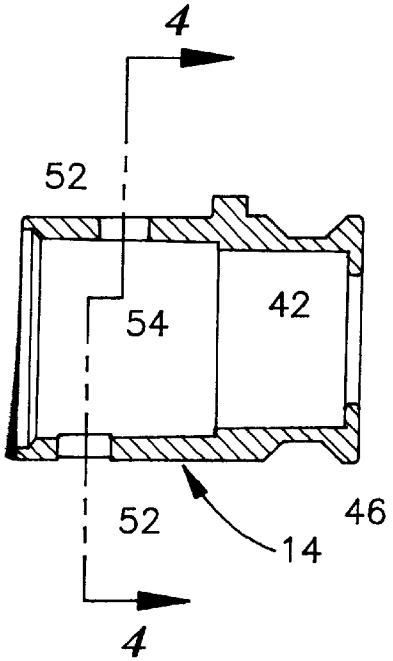
FIG. 3 is a sectional view of the male component taken on section 3—3 of FIG. 6.
Figure 8:
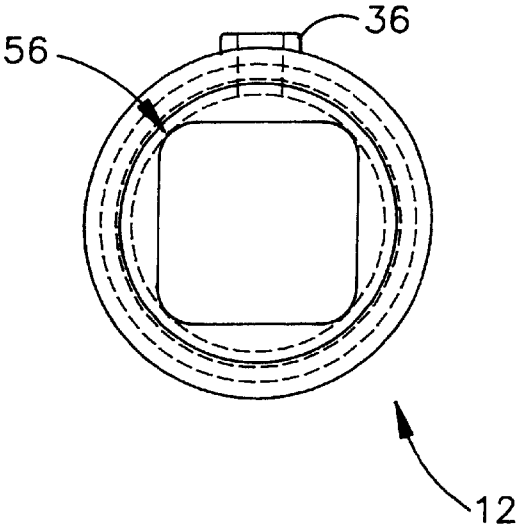
FIG. 8 is an end view of FIG. 7.
Figure 7:
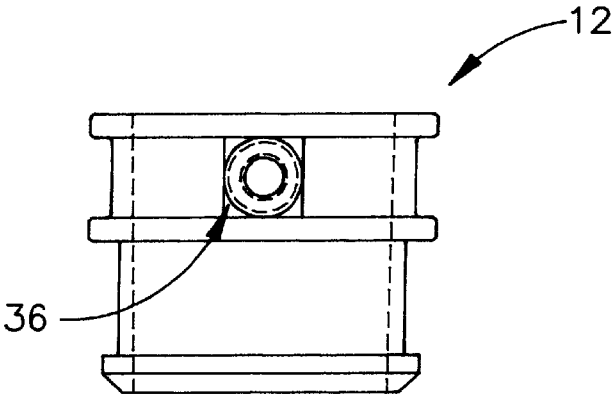
FIG. 7 is a top view of the female component.
Figure 6:
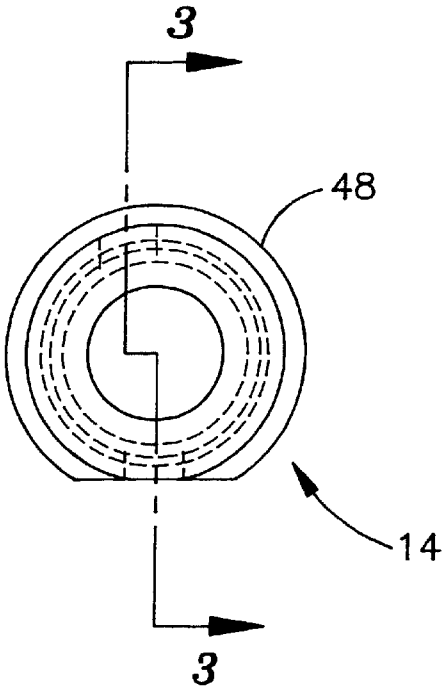
FIG. 6 is an end view from the right side of FIG. 3.
Figure 10:
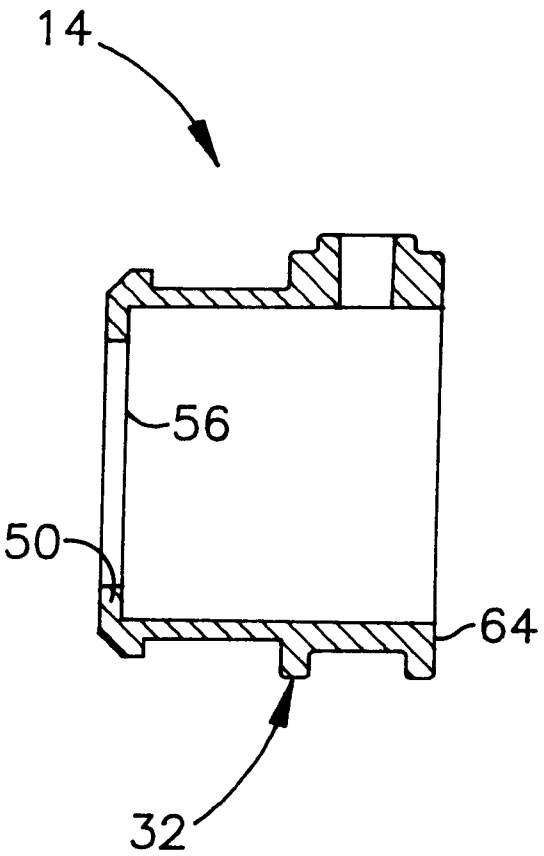
FIG. 10 is a cross-sectional view of FIG. 9.
Figure 9:
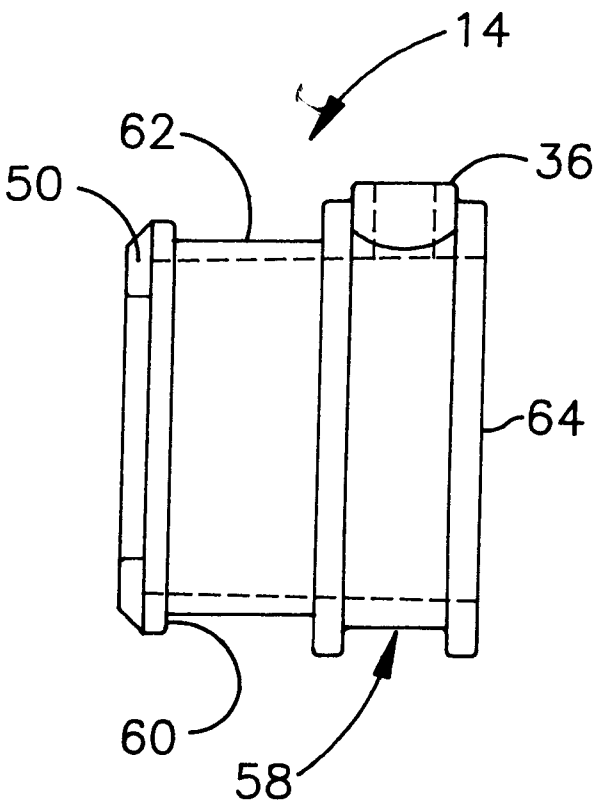
FIG. 9 is a side view of FIG. 7.

With reference to FIGS. 1 to 10, there is shown an assembled end 10 of a pre-connectorized cable. Female component 12 is shown inserted through an opening 22 in the wall of a typical electrical box 34. The female component is inserted by means of a quick connect snap fit ring 16 and held in position by the spring. Recessed in cavity 24 is a wiring harness connector or plug 26 with the forward end connected to a mating plug, which is not shown.

The female component 12 has a shoulder 28 for retaining a complimentary enlargement 30 of the wiring harness connector. The female component also has a second shoulder 32 which is larger in diameter than the opening 22 in the electrical box wall 34. The cavity 24 is of the same internal dimensions, except for the shoulder 28, to match the exterior dimensions of the wiring harness connector 26 to permit easy insertion and extraction.

The female component 12 also has a boss 36, which contains a set of locking screws 38. The shoulder 32 of the female component and the attachment device or boss 36 and locking screw attachment 38 lie outside of the box wall.

A second component of the separable snap in cable connector is the male component 14 which contains therein an armored cable 20 with helical windings. The armored cable 20 is held in the male component by a snap in locking spring 18 of the type shown in Applicant's pending U.S. patent application Ser. No. 09/007,532 filed Jan. 15, 1998, and Ser. No. 09/165,530 filed Oct. 2, 1998. At the forward end of the cavity in the male component rests an anti-short or plastic bushing 40 which is held by a shoulder 42. Protruding from the end of armored cable 20 are the electrical wires, fiber optic cable or other telecommunication wires 44.

The male component 14 has an exterior circular recess 46 which can be rotated inside the female component 12 until the desired orientation is made and then locked in place by means of the locking screw 38. The forward movement of the male component 14 into the female component 12 is arrested by shoulder 48 when it comes into contact with the outer or rear surface 64 of the female component.

Applicant's U.S. Pat. No. 5,373,106 and U.S. patent applications Ser. No. 09/007,532 filed Jan. 15, 1998, and Ser. No. 09/165,530 filed Oct. 2, 1998, are incorporated and referenced in their entirety herein. As used in this application, cable includes armored cable, metal clad cable, flexible metal conduit and other external protection for wiring or optical transmission devices contained therein.

The snap locking features of this invention include the snap and locking spring 18 which not only locks the spring onto the cable but locks the spring into tang lock openings 52 in the walls of male component 14. The interior of the male component 14 has a recess 54 for accommodating the spring.

The snap spring or ring 16 includes an easy to use snap in on the female component 12 laying in a recess 62 with a forward shoulder 60 that permits the female component to be easily inserted into place. Thus, the connector assembly of the two components are locked together by a separable fastener such as by a lock screw 38 and the circular recess 46. This permits an easy connection to both the cable 20 and the opening 22 yet permits both components to be easily separated.

The interior of the female component has a configured opening 56, on the forward or inner face 50 for receiving a plug. The female component also has a rearward end 58 with an outer or rearward surface 64. The configured opening is designed to be complimentary to any wiring harness connector or plug placed therein.

There has been described a pre-connectorized cable that may be factory-assembled in advanced with the end of the cable being inserted into a male component and held therein by the snap and locking spring and then wired into a plug which then is inserted and locked into the female component for shipping to the user. The user can then take the end of the cable and plug into a complimentary plug and then insert connector and plug the assembly, using the snap ring, into an appropriate opening in the wall of an electrical or communications box. The assembly is held in the wall by means of the snap fitting on the leading or front surface of the female component and is retained in the wall when a rearrangement of the box or wall becomes desirable. The male component can be unfastened by the simple expedience of unscrewing the attachment and pulling the male component, the cable and wiring harness connector from the box where the two plugs can be readily disconnected and the cable moved to another location. The original female component can remain in place and an additional female component can be used in a new location if such is desired.

Thus there is presented a simple solution to a difficult problem and since the factory assembly pre-connectorized cable eliminates the time and cost of field assembly by the user as it can be very simply put into position by just inserting the assembly into the installation and yet can be readily removed by unlocking the male component and either adding additional wires or moving the component to a new location.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. A pre-connectorized cable comprising;

A cable;

A plug attached at one end of said cable;

A female component having a forward end for attachment through a wall;

A cavity in said forward end of said female component adapted to receive said plug;

A male component attached to said cable at one end;

A locking spring in said male component for locking into said male component and locking onto said cable; and An attachment device for removably locking said male component to said female component.

2. A separable snap in connector comprising:

A female component having a forward end for attachment through a wall;

A cavity in said forward end of said female component;

A snap in fitting surrounding said forward end of said female component;

A male component inserted in said female component;

A locking spring in said male component for locking into said male component and locking onto a cable; and An attachment device for removably locking said male component into said female component.

* * * * *